United States Patent [19]

Morrow, deceased

[11] 4,431,053

[45] Feb. 14, 1984

[54] WELL DRILLING TOOL

[75] Inventor: Timothy N. Morrow, deceased, late of New Iberia, La., by Ann M. Morrow, Administratrix

[73] Assignee: Texaco Inc., White Plains, N.Y.

[21] Appl. No.: 325,535

[22] Filed: Nov. 27, 1981

[51] Int. Cl.[3] ..... E21B 31/14

[52] U.S. Cl. ..... 166/117.5; 166/381; 166/316; 166/301

[58] Field of Search ..... 166/98, 99, 117.5, 301, 166/316, 381

[56] References Cited

U.S. PATENT DOCUMENTS 2,558,227 6/1951 Yancey et al. ..... 175/82

3,139,932 7/1964 Johnson ..... 166/316

*Primary Examiner*—Stephen J. Novosad

*Assistant Examiner*—William P. Neuder

*Attorney, Agent, or Firm*—Carl G. Ries; Robert A. Kulason; Henry C. Dearborn

[57] ABSTRACT

A special tool for use in fishing operations during well drilling when a so-called string shot is used. The tool is made up of a hollow sub that may be connected into a string of pipe for lowering in the well. And, it includes a sliding sleeve in the sub. There is a gate in the wall of the hollow sub that is held in place by the sliding sleeve so as to leave the hollow sub open when a preliminary fishing opertion is attempted. And, there is means associated with the sleeve for sliding it to a different position so that the gate will be shifted in order to guide a string shot to the outside in case the inside of the fish is plugged.

7 Claims, 5 Drawing Figures

WELL DRILLING TOOL

BACKGROUND OF THE INVENTION

Field of the Invention

This invention concerns a tool that is useful in drilling wells, particularly deep wells being drilled for oil and/or gas production. More specifically, it concerns a special tool that is useful in connection with so-called fishing operations. Such operations involve actions for loosening and thereafter recovering a so-called "fish", which may be any substantial amount of drilling pipe or other equipment which has become stuck in a hole and is worth recovering.

Description of the Prior Art

As used throughout this application the terms fish and fishing operations, deal with the common usage of these terms in connection with well drilling and particularly oil and/or gas wells of considerable depths where rotary drilling equipment and operations are employed. It has been found that during fishing operations a fish that is to be recovered is ordinarily latched with an overshot, and then a so-called string-shot is run down through the pipe that has the overshot at the lower end. The jarring effect of detonating the string shot may help loosen or, if necessary, sever the fish so that the latched portion may be withdrawn and so recovered. However, when during such a fishing operation the fish itself is found to be plugged, the string shot is not able to penetrate down inside the fish. And, consequently such conditions necessitate the withdrawing of the entire string of pipe to which the overshot is attached in order that a different tool may be connected in order to direct the string shot to the outside of the fish so that it may continue down in the annulus but outside of the stuck fish. Particularly in deep well operations, the additional so-called trip which involves pulling up the string of pipe and inserting the extra tool, requires very considerable time and effort. Consequently, provision of a tool according to this invention avoids such a trip and saves much effort and time in connection with a fishing operation.

It will be appreciated by those skilled in the art that many of the terms employed in describing the tools and procedures herein are well known in well drilling operations and thus are well understood by such skilled artisans.

There is a U.S. Pat. No. 2,558,227 to J. R. Yancey et al, issued June 26, 1951. However, that patent deals with structure for carrying out a sidewall core-taking procedure which means that a core bit may be directed from inside of a string of pipe or tubing out into the formation. It includes a special structure at the lower end for diverting the core bit. That structure has a diverting "deflector plate assembly" which provides a sloping surface that directs the lower end of the core-taking equipment out into the formation at that location. However, such structure is not relevant to the applicant's invention which includes a gate that may be positioned as part of the wall of the tool so as to leave the inside completely open.

SUMMARY OF THE INVENTION

Briefly, the invention concerns a well drilling tool for fishing operations. It comprises in combination a hollow sub adapted for connection into a string of pipe used for a fishing operation, and a sliding sleeve in said sub. It also comprises a gate cooperating with said sliding sleeve and leaving said hollow sub open during the beginning of said fishing operation, and means associated with said sleeve for sliding it to a different position for shifting said gate in the event that a fish is plugged. The entire combination is effective so that an outside string-shot may be employed without pulling said string of pipe to change subs.

Once more, briefly, the invention concerns a well drilling tool for fishing operations including use of a string-shot. It comprises in combination a hollow sub adapted for connection into a string of pipe used for a fishing operation, and a sliding sleeve in said sub having an upper and a lower position. It also comprises a gate integral with a wall portion of said sub and cooperating with said sliding sleeve. The said gate leaves said hollow sub open when said sliding sleeve is in said lower position. The combination also comprises an increased inside diameter section on said sleeve for use in sliding it from said lower to said upper position, and a shallow longitudinal trough on the outside of said gate for guiding said string shot from inside said hollow sub to the outside thereof. It also comprises hinge means located adjacent to the lower edge of said gate. The said hinge means comprises a pair of hinge pins located in the wall of said sub, and coil springs associated with said hinge pins for biasing said gate against said sliding sleeve when in said lower position whereby said gate will shift when said sleeve slides from said lower to said upper position.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings wherein.

DESCRIPTION OF THE PREFERRED EMBODIMENT

Figure 1:
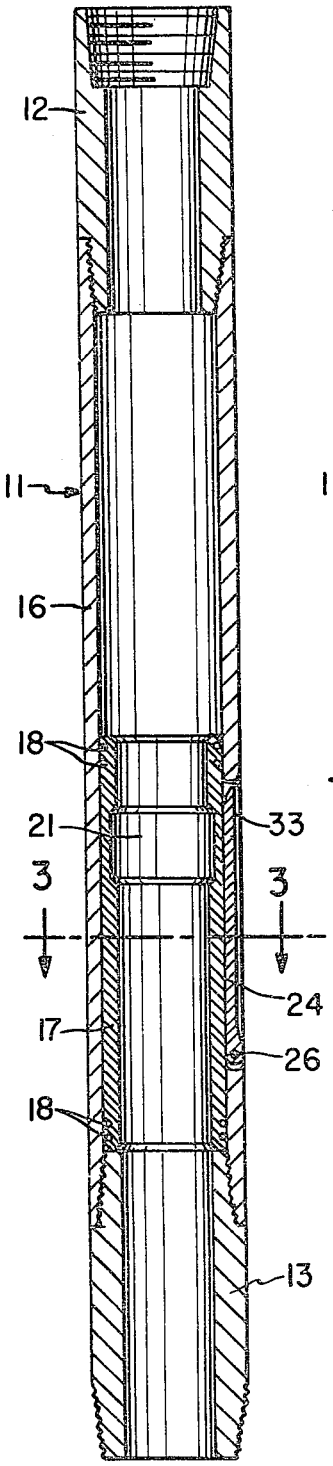
FIG. 1 is a longitudinal cross-sectional view of a tool according to the invention.

As indicated above, in connection with oil and gas well drilling operations, there are many terms employed which have become common and well known and about which anyone skilled in the art is quite familiar. Consequently, throughout this application such terms have their common and expected meanings that are clear to anyone skilled in this art. Thus, for example, the tool according to this invention may be characterized as a "sub" which means that it is an element that is adapted to be connected at or near the lower end of a string of drill pipe or tubing as used in connection with drilling operations.

A tool, according to this invention, is made up of a hollow sub 11 which has an internal pipe threaded section 12 at the upper end, and external pipe threaded section 13 at the lower end thereof. In that manner it is adapted for being connected into a string of pipe (not shown) that is employed in a fishing operation. There is a central section 16 of the sub 11 which has a sliding sleeve 17 therein. The sleeve 17 is shown in its lower position in FIG. 1, and it has sealing rings 18 near the upper and lower ends on the outside of the sleeve 17. These permit sliding movement of the sleeve 17 inside of the central section 16 but maintain fluid seals therewith.

Figure 2:
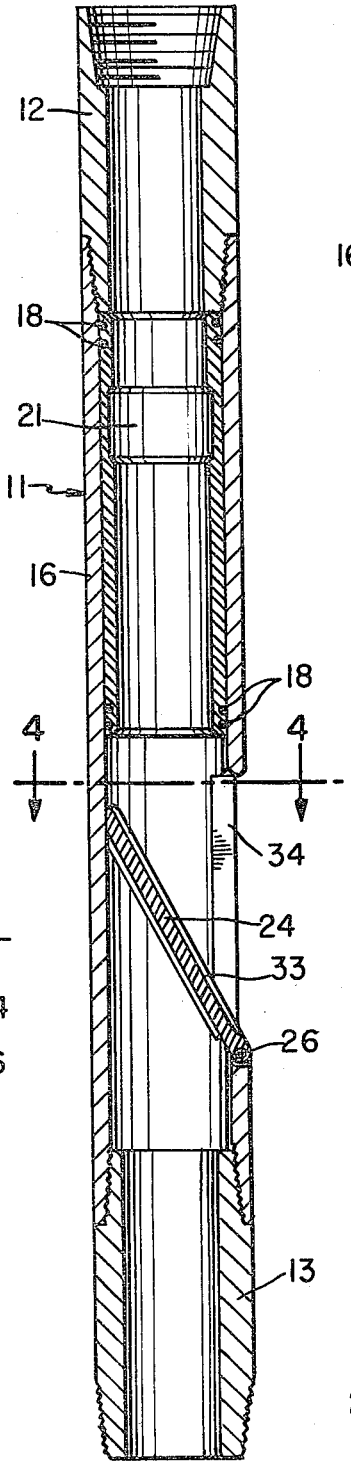
FIG. 2 is another longitudinal cross-sectional view like FIG. 1 but with the sliding sleeve moved from its lower to its upper position.

On the inside of the sliding sleeve 17 there is an increased inside diameter section 21 that is designed for receiving an expandable element (not shown) on a tool (not shown) that may be run down inside of the pipe or tubing string (not shown), in order to shift the sleeve 17 from its lower position (illustrated in FIG. 1) to its upper position as illustrated in FIG. 2.

Figure 3:
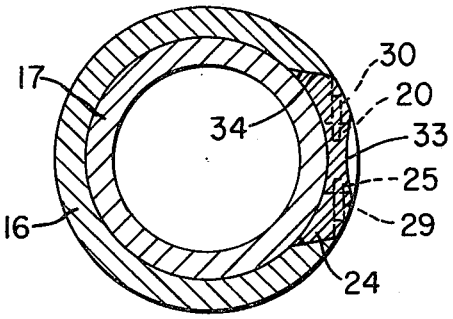
FIG. 3 is a transverse cross-sectional view somewhat enlarged, taken along the lines 3—3 of FIG. 1 and looking in the direction of the arrows.
Figure 4:
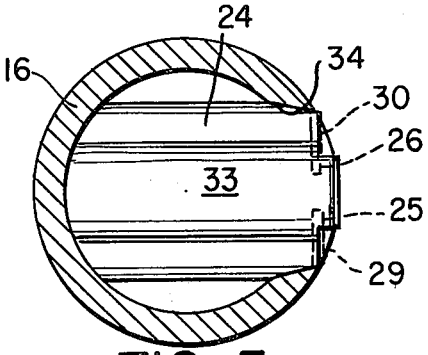
FIG. 4 is another transverse cross-sectional view somewhat enlarged, taken along the lines 4—4 of FIG. 2 and looking in the direction of the arrows.
Figure 5:
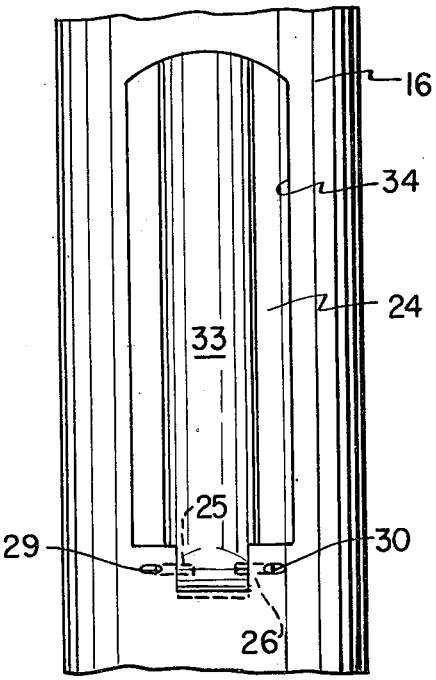
FIG. 5 is an enlarged detail in elevation, showing the gate structure looking from the outside of the tool.

There is a gate 24 that is integral with a portion of the wall of the central section 16, to which it is attached. Thus, when the gate 24 is in its closed position as illustrated in FIGS. 1, 3 and 5, the inside surface of the gate is flush with the inside of central section 16 and forms a contiguous portion thereof. However, the gate 24 is fastened onto the central section 16 by having a pair of hinge pins 25 and 26 that are located in the wall of central section 16 at the lower end of the gate 24. These pins 25 and 26 have coil springs 29 and 30 effectively incorporated in such manner as to apply a bias force tending to move the gate 24 inward to the open position that is illustrated in FIG. 2.

The gate 24 also has a shallow longitudinal trough 33 on the outside thereof. It extends from top to bottom of the gate 24 and acts to guide a string-shot (not shown) when it is lowered down through the hollow interior of the sub 11. The string shot will be thus diverted out through an opening 34 that is created when the gate 24 is in its open position.

OPERATION

It may be noted that in employing a tool according to this invention the sub 11 would be connected into a string of pipe or tubing (not shown) that would be used in a fishing operation. Such string of pipe would have an overshot (not shown) connected at the lower end thereof in order to engage a fish downhole. Then, the first step with the sub 11 in place, is that of determining whether the fish is open so that a string shot could be lowered down through the hollow interior of sub 11 and continue to a desired depth within the fish. In that case the tool according to this invention would merely act as a conduit for the string shot on the way down. However, if it is determined that the fish is plugged (so that the string shot may not be lowered as desired into the fish) then the string shot is readily pulled up above the gate 24 while the sliding sleeve 17 is shifted to its upper position, which is illustrated in FIG. 2.

It will be understood that a tool (not shown) for making connection with the section 21 of the sliding sleeve 17 could be attached to the line (not shown) that supports the string shot. Then the sliding sleeve 17 would be pulled upward to its upper position as illustrated in FIG. 2 so that the gate 24 would shift to its inward position and so open the opening 34 in the wall of the central section 16. When open, the gate 24 will provide a sloped guiding surface, including the trough 33. Thereafter, the string shot may be lowered again and it will be diverted out through the hole 34 to the outside, i.e. the annulus of the hole, where it may then be lowered on down beside the fish to a desired location in order to carry out the loosening or severing operation prior to recovery of the fish.

It will be appreciated that in deep well operations where a substantial amount of equipment has been lost down hole and the recovery of the "fish" is called for, the time and trouble of carrying out such fishing operation is expensive so that anything that saves time is very worth while. Therefore, it is a major advantage of this invention to be able to provide for the ability to permit a string shot to be directed to the outside of the fish after it has been discovered that the fish is plugged. This is done without the previous requirement of raising the entire string of pipe or tubing to which an overshot is attached in order to be able to connect a diverting tool and then reconnecting the string to reinsert it in the hole so that the string shot may be thereafter directed to the outside.

In other words, the previous practice involved an attempt to recover a fish using a string shot. And, in the event that the fish was found to be plugged it was necessary to make a complete trip, i.e. to remove the entire string of pipe or tubing in order to connect a so-called inside-outside tool. That tool would allow the string shot to be directed out into the annulus, downhole near the fish. On the other hand, by having a tool according to this invention the beginning of a fishing operation may be carried out and if the fish is not plugged, the operation may proceed as expected. But, if the fish is found to be plugged, much time is saved by having a tool according to this invention in place so that the sliding sleeve 17 of the sub 11 may be shifted and thereafter the string shot will be diverted out into the annulus in order to carry out the fishing operation from the outside, without the necessity of making the "trip".

While a particular embodiment of the invention has been described above in considerable detail in accordance with the applicable statutes, this is not to be taken as in any way limiting the invention but merely as being descriptive thereof.

I claim:

1. Well drilling tool for fishing operations comprising in combination a hollow sub adapted for connection into a string of pipe used for a fishing operation, a sliding sleeve in said sub, a gate in said sub adapted to cooperate with said sliding sleeve, said gate leaving said hollow sub open during the beginning of said fishing operation, and means associated with said sleeve for sliding it to a different position to permit shifting said gate in the event that a fish is plugged, whereby an outside string shot may be employed without pulling said string of pipe to change subs.

2. Well drilling tool according to claim 1, wherein said sliding sleeve has an upper and a lower position, and said combination further comprises means on said gate for shifting it when said sliding sleeve moves from said lower to said upper position.

3. Well drilling tool according to claim 2, wherein said gate is integral with a portion of the wall of said sub, and said shifting means is located adjacent to the lower edge of said gate.

4. Well drilling tool according to claim 3, also comprising a trough on the outside of said gate for guiding a string shot to the outside of said hollow sub.

5. Well drilling tool according to claim 4, wherein said shifting means comprises means for biasing said gate toward said shifted position.

6. Well drilling tool according to claim 5, wherein said shifting means also comprises a pair of hinge pins located in the wall of said sub, and said biasing means comprises coil springs associated with said hinge pins.

7. Well drilling tool for fishing operations including use of a string shot, comprising in combination a hollow sub adapted for connection into a string of pipe used for a fishing operation, a sliding sleeve in said sub having an upper and a lower position, a gate integral with a portion of the wall of said sub and cooperating with said sliding sleeve, said gate leaving said hollow sub open when said sliding sleeve is in said lower position, an increased inside diameter section on said sleeve for use in sliding it from said lower to said upper position, a shallow longitudinal trough on the outside of said gate for guiding said string shot from inside said hollow sub to the outside thereof, and means located adjacent to the lower edge of said gate, comprising a pair of hinge pins located in the wall of said sub, and coil springs associated with said hinge pins for biasing said gate against said sliding sleeve when in said lower position whereby said gate will shift when said sleeve slides from said lower to said upper position.

* * * * *